US012687361B2

(12) United States Patent
Fellows

(10) Patent No.: US 12,687,361 B2
(45) Date of Patent: Jul. 21, 2026

(54) TRIGGER ASSEMBLY FOR A FIREARM

(71) Applicant: Franklin Armory Holdings, Inc., Minden, NV (US)

(72) Inventor: Ryan Paul Fellows, Hollister, CA (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 203 days.

(21) Appl. No.: 18/430,297

(22) Filed: Feb. 1, 2024

(65) Prior Publication Data

US 2024/0263902 A1 Aug. 8, 2024

Related U.S. Application Data

(60) Provisional application No. 63/442,917, filed on Feb. 2, 2023.

(51) Int. Cl.
*F41A 19/10* (2006.01)
*F41A 19/11* (2006.01)

(52) U.S. Cl.
CPC ..... *F41A 19/10* (2013.01); *F41A 19/11* (2013.01)

(58) Field of Classification Search
CPC ..... F41A 19/10; F41A 19/11
See application file for complete search history.

(56) References Cited

U.S. PATENT DOCUMENTS 2,056,975 A 10/1936 Michal, Jr.
2,139,691 A 12/1938 Michal, Jr.
7,398,723 B1 7/2008 Blakley
9,021,732 B2 5/2015 Johnson
9,267,751 B2 2/2016 Ruiz
9,518,793 B1 12/2016 Stakes
9,568,264 B2 2/2017 Graves
9,733,034 B1 * 8/2017 Viani ..... F41A 19/10
9,816,772 B2 11/2017 Graves
9,829,263 B2 11/2017 Bonner
9,939,221 B2 4/2018 Graves
9,989,327 B2 6/2018 Horch
10,514,223 B1 12/2019 Rounds
11,346,627 B1 5/2022 DeMonico
11,724,003 B2 8/2023 Strbac
12,031,784 B1 7/2024 DeMonico
12,036,336 B2 7/2024 Strbac
(Continued)

*Primary Examiner* — J. Woodrow Eldred
(74) *Attorney, Agent, or Firm* — Bennet K. Langlotz; Langlotz Patent & Trademark Works, LLC

(57) ABSTRACT

A trigger assembly for a firearm has a frame, a trigger element pivotally connected to the frame and having a trigger lever operable for movement between a forward released position and a rearward actuated position, a hammer pivotally connected to the frame and movable between a cocked position and a striking position, a shroud element pivotally connected to the frame and having a shroud lever operable for movement between a forward disabling position and a rearward enabling position, a link pivotally connected to the frame and having a first portion operably interfacing the reciprocating action element and a second portion operably interfacing the shroud element, and the link being operable when the reciprocating action element moves from the rear recoil position to the forward battery position to motivate the shroud element from the rearward enabling position to the forward disabling position.

9 Claims, 14 Drawing Sheets

(56) References Cited

U.S. PATENT DOCUMENTS

| | | | | |
|---|---|---|---|---|
| 12,038,247 | B2 | 7/2024 | Blakley | |
| 12,169,105 | B1 | 12/2024 | Barry | |
| 12,274,807 | B2 | 4/2025 | Strbac | |
| 2019/0353443 | A1* | 11/2019 | Gillette | F41A 19/12 |
| 2023/0136053 | A1* | 5/2023 | Torres | F41A 19/10<br>42/69.01 |
| 2024/0003643 | A1* | 1/2024 | Montgomery | F41A 17/54 |
| 2025/0012535 | A1 | 1/2025 | Barry | |

* cited by examiner

TRIGGER ASSEMBLY FOR A FIREARM

CROSS-REFERENCE TO RELATED APPLICATION

This application claims the benefit of U.S. Provisional Patent Application No. 63/442,917 filed on Feb. 2, 2023, entitled "SHROUDED TRIGGER FIRE CONTROL GROUP," which is hereby incorporated by reference in its entirety for all that is taught and disclosed therein.

FIELD OF THE INVENTION

The present invention relates to firearms, and more particularly to a trigger assembly for a firearm that forces the finger of the user off the trigger between each shot fired.

BACKGROUND OF THE INVENTION

Semi-automatic firearms are legally defined in many jurisdictions as firearms that utilize a portion of the energy of a firing cartridge to extract the fired cartridge case and chamber the next round, and which require a separate pull of the trigger to fire each cartridge. A trigger group includes all parts of the firearm that initiate detonation of the cartridge primer to launch a projectile or projectiles. The parts of a trigger group include a trigger having a sear surface that is manipulated by one or more fingers of the firing hand, a sear that holds the hammer back until the trigger has been pulled, a disconnector that holds the hammer in place until the trigger is released and the sear takes over hammer retention after a cycle of semi-automatic fire has occurred, and several springs located throughout the trigger group. The sear may be a separate part or can be a surface incorporated into the trigger. As the trigger is pulled, the sear slips out from engagement with the hammer, allowing the hammer to strike the firing pin to discharge a round.

In the United States, the National Firearms Act, 26 U.S.C. 5845(b), defines a machine gun as any firearm that fires more than one round per function of the trigger. Regulatory agencies have historically opined that trigger systems that force the trigger to reset via a mechanical interaction with the action are also machine guns, regardless of whether the trigger functions only once per shot fired, because the user continuously engages the trigger with a rearward effort of the trigger finger.

Therefore, a need exists for a new and improved trigger assembly for a firearm that forces the finger of the user off the trigger between each shot fired, thereby eliminating any continuity of trigger function between each shot fired. In this regard, the various embodiments of the present invention substantially fulfill at least some of these needs. In this respect, the trigger group for semi-automatic firearms according to the present invention substantially departs from the conventional concepts and designs of prior art and, in doing so, provides an apparatus primarily designed to facilitate a forced separation of the finger of a user and the trigger of a semi-automatic firearm between each shot fired.

SUMMARY OF THE INVENTION

The present invention provides an improved trigger assembly for a firearm, and overcomes the above-mentioned disadvantages and drawbacks of the prior art. As such, the general purpose of the present invention, which will be described subsequently in greater detail, is to provide an improved trigger assembly for a firearm that has all the advantages of the prior art mentioned above.

To attain this, the preferred embodiment of the present invention essentially comprises a frame, a trigger element pivotally connected to the frame and having a trigger lever operable for movement between a forward released position and a rearward actuated position, a hammer pivotally connected to the frame and movable between a cocked position and a striking position, a shroud element pivotally connected to the frame and having a shroud lever operable for movement between a forward disabling position and a rearward enabling position, a link pivotally connected to the frame and having a first portion operably interfacing the reciprocating action element and a second portion operably interfacing the shroud element, and the link being operable when the reciprocating action element moves from the rear recoil position to the forward battery position to motivate the shroud element from the rearward enabling position to the forward disabling position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
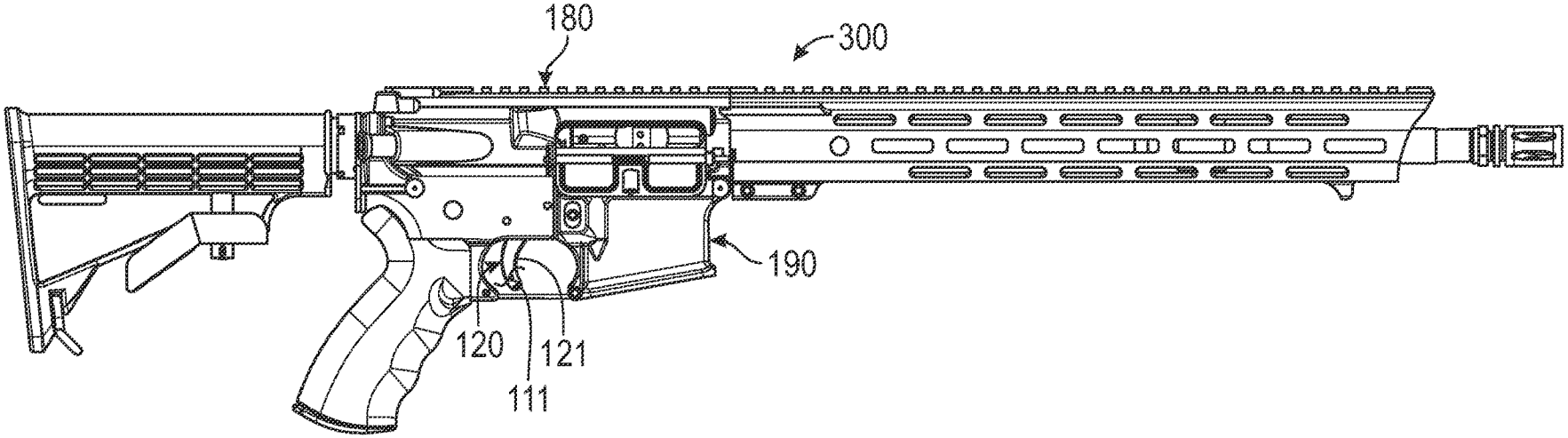
FIG. 1 is a side view of the current embodiment of a trigger assembly for a firearm constructed in accordance with the principles of the present invention installed in a complete host firearm with the trigger element and the shroud element in the disengaged position and a portion of the shroud element shown cutaway.

An embodiment of the trigger assembly for a firearm of the present invention is shown and generally designated by the reference numeral 10.

Figure 2:
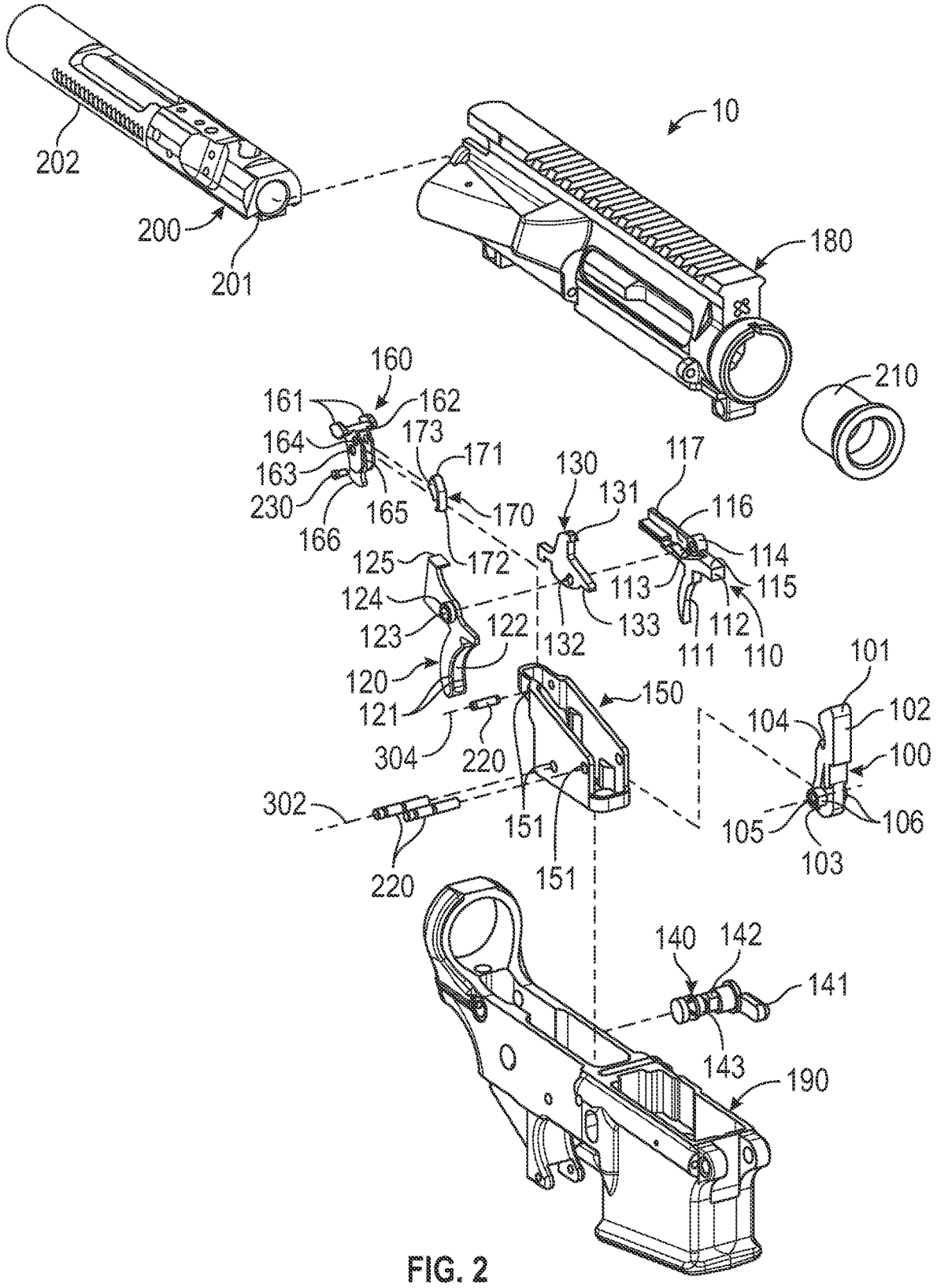
FIG. 2 is an exploded view of the trigger assembly for a firearm of FIG. 1.

FIGS. 1 & 2 illustrate the improved trigger assembly for a firearm 10 of the present invention. More particularly, the trigger assembly for a firearm includes a hammer 100, a trigger element 110, a shroud element 120, a disconnector 130, a selector 140, a housing 150, link 160, and link disconnector 170. The complete host firearm 300 shown in FIG. 1 that receives the trigger assembly includes an upper receiver 180 and lower receiver 190, a reciprocating action element 200, and a barrel extension 210. The lower receiver can be viewed as the frame of the complete host firearm, and the reciprocating action element is a reciprocating bolt assembly in the current embodiment. The trigger element is pivotally connected to the frame and has a trigger lever/finger pad 111 operable for movement between a forward released position and a rearward actuated position. The shroud element is pivotally connected to the frame and has a shroud lever/finger pad 121 operable for movement between a forward disabling position and a rearward enabling position. The shroud element and trigger element pivot about a common axis 302. The link is pivotally connected to a housing 150 and has a first portion operably interfacing the reciprocating action element and a second portion operably interfacing the shroud element. The reciprocating action element cycles as part of the action and is movable between a rear recoil position and a forward battery position. The barrel extension is rigidly engaged with the upper receiver to constrain the forward battery position of the reciprocating action element. The user has a finger 240 (shown beginning with FIG. 3) that has either the condition of a pulling effort or a releasing effort with respect to the trigger element. When assembled, the hammer, trigger element, shroud element, disconnector, and link are connected to the housing.

Each side of the housing 150 has apertures 151 to receive cross pins 220 upon which the hammer, trigger element, shroud element, disconnector, and link are pivotally mounted. The housing is contained within the lower receiver 190. The hammer 100 has a top 101, a striking surface 102, a bottom hook 103, a rear hook 104, a through hole 105, and bosses on the sides 106. The trigger element 110 has a finger pad 111, a sear surface 112, a through hole 113, a boss 114, a top surface 115, a cavity 116, and a rear contact surface 117. The shroud element 120 has a finger pad 121, a slot 122, a through hole 123, a boss 124, and a contact surface 125. The disconnector 130 has a hook 131, a through hole 132, and a contact face 133.

The link 160 has a top contact surface 161, an inner contact surface 162, a first through hole 163, a second through hole 164, a slot 165, and a fin 166. The link is operable when the reciprocating action element 200 moves from the rear recoil position to the forward battery position to motivate the shroud element 120 from the rearward enabling position to the forward disabling position. The link disconnector 170 has a top contact surface 171, a lower contact surface 172, and a through hole 173. The link disconnector 170 is assembled within the link 160 such that the link disconnector nestles in the slot 165 and rotates about the pin 230 that is received by the second through hole 164. The link disconnector 170 is spring-biased toward the engaged position. The link is movable between an inactive position enabling the finger pad 121 on the shroud element to be in the rearward enabling position, and a link active position contacting the finger pad on the shroud element. The link is operable in response to a forward force by the reciprocating action element 200 on the first link portion to transmit a biasing force on the shroud element to bias the finger pad on the shroud element toward the forward disabling position.

The selector 140 has a paddle 141, a first contact profile 142, and a second contact profile 143. The selector interfaces the link 160 and is movable between a first operating condition in which link movement is enabled to motivate the shroud element 120 and a second operating condition in which link movement is disabled from motivating the shroud element. The selector also interfaces the trigger element 110 and is movable to a third position in which operation of the trigger element is disabled.

Figure 3:
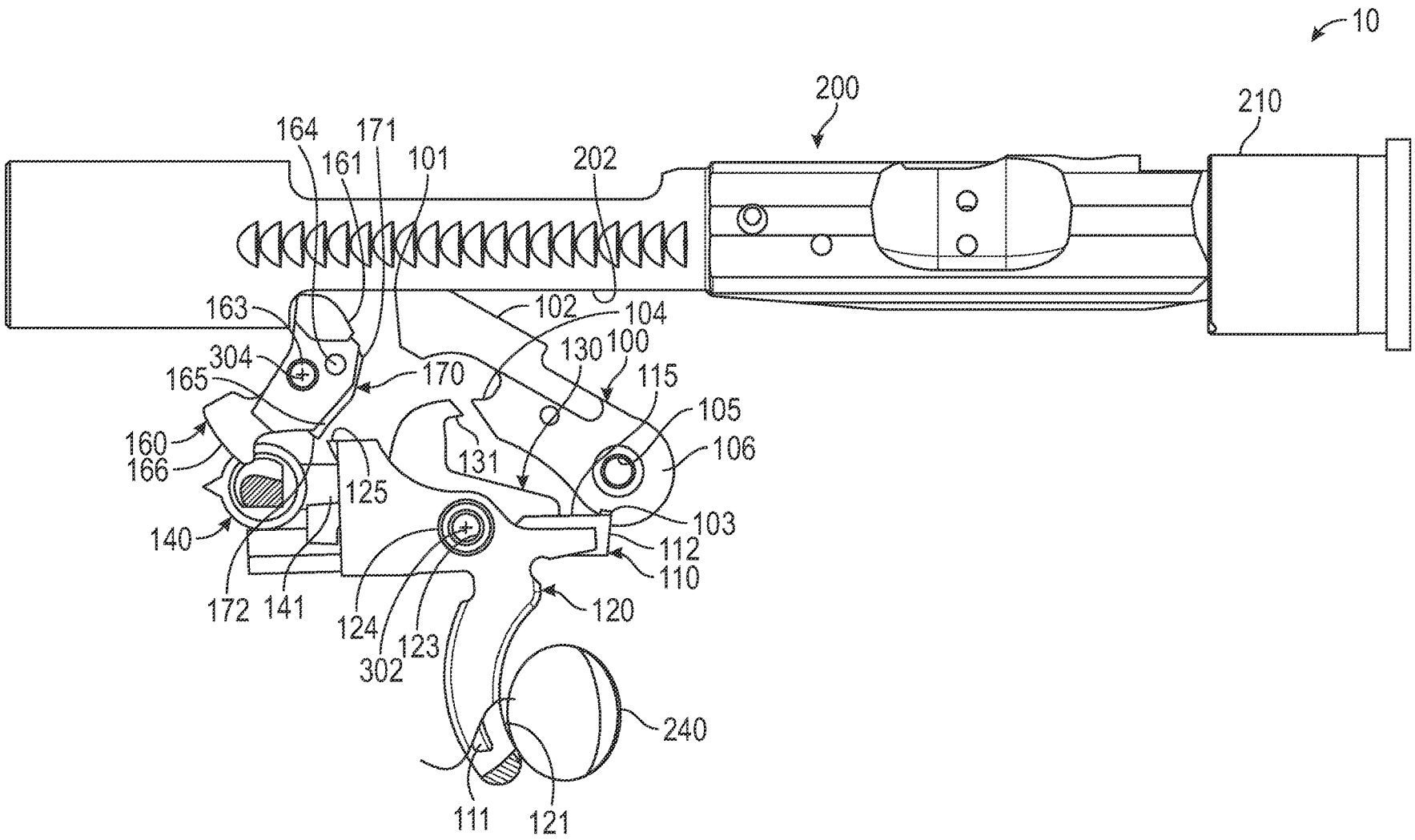
FIG. 3 is a side view of the trigger assembly for a firearm of FIG. 1 with the trigger element and the shroud element in the forward disabling position and a portion of the shroud element shown cutaway, the hammer in the cocked position, the link in the engaged position, the link disconnector in the engaged position, the selector shown cutaway and positioned to enable the forced separation mode of fire, and the user's finger beginning to pull, acting solely on the shroud element.
Figure 4:
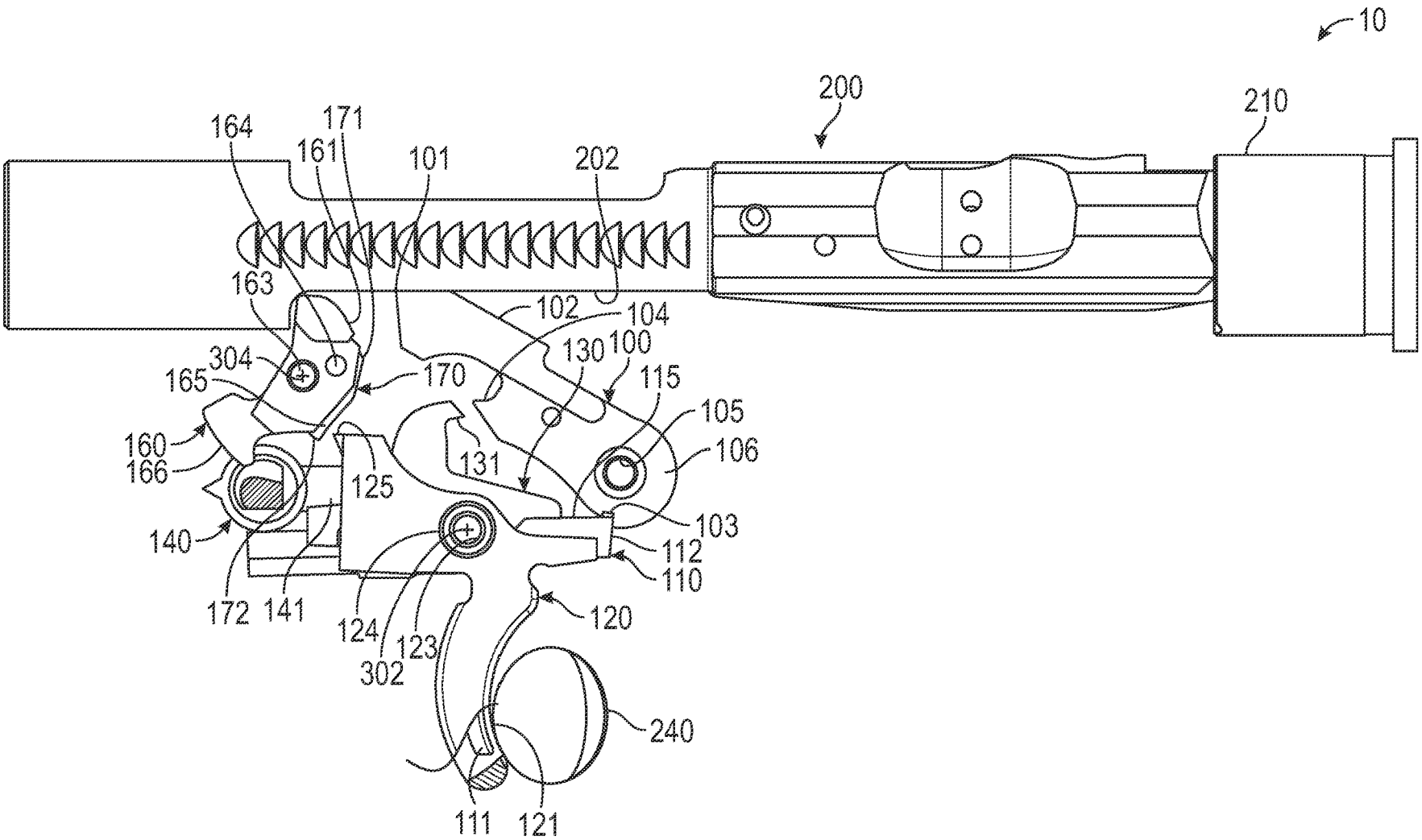
FIG. 4 is a side view of the trigger assembly for a firearm of FIG. 1 with a portion of the shroud element shown cutaway with the user's finger having pulled further relative to FIG. 3, but still only acting upon the shroud element because the shroud element has yet to reach the rearward enabling position.
Figure 5:
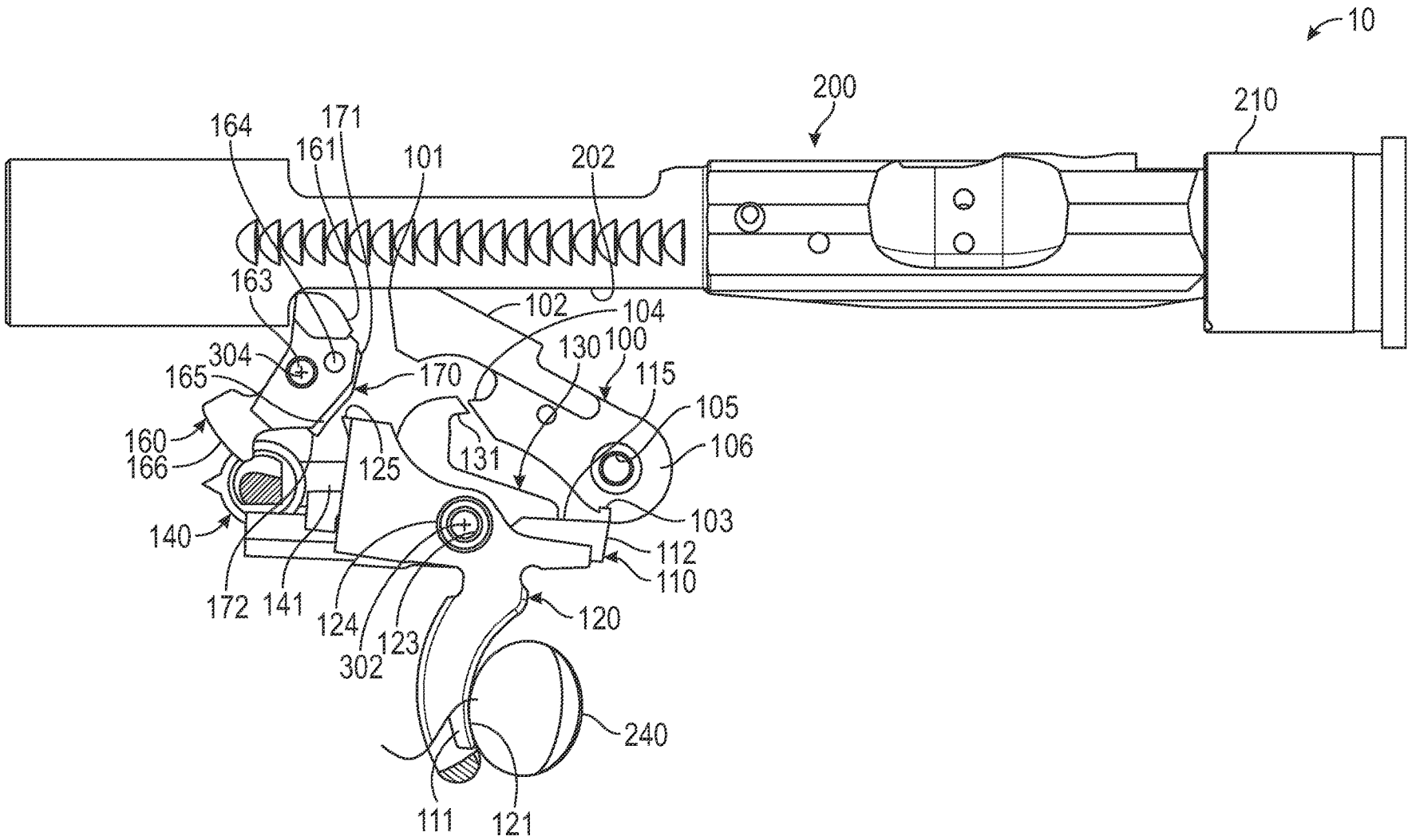
FIG. 5 is a side view of the trigger assembly for a firearm of FIG. 1 with a portion of the shroud element shown cutaway with the user's finger having pulled further relative to FIG. 4. The user's finger has pulled both the shroud element and the trigger element far enough to be past the point of releasing the hammer from the cocked position, with the hammer in the striking position at the point of discharging the complete host firearm.

FIGS. 3-5 illustrate the improved trigger assembly for a firearm 10 of the present invention. More particularly, the initial firing sequence is depicted, starting with the hammer 100 resting in the cocked position. Engagement of the sear surface 112 of the trigger element 110 against the bottom hook 103 of the hammer prevents the hammer from falling forward to the striking position under spring bias (spring not shown). The user's finger 240 is in the condition of a pulling effort with respect to the trigger element. The finger pad 121 of the shroud element 120 is acted upon by the user's finger. The shroud element rotates until the user's finger 240 also contacts the finger pad 111 of the trigger element. The user's finger continues to pull after both finger pads are contacted. This action rotates both the trigger element and shroud element until the sear surface 112 reaches the point of disengagement with the bottom hook 103 of the hammer 100.

Figure 6:
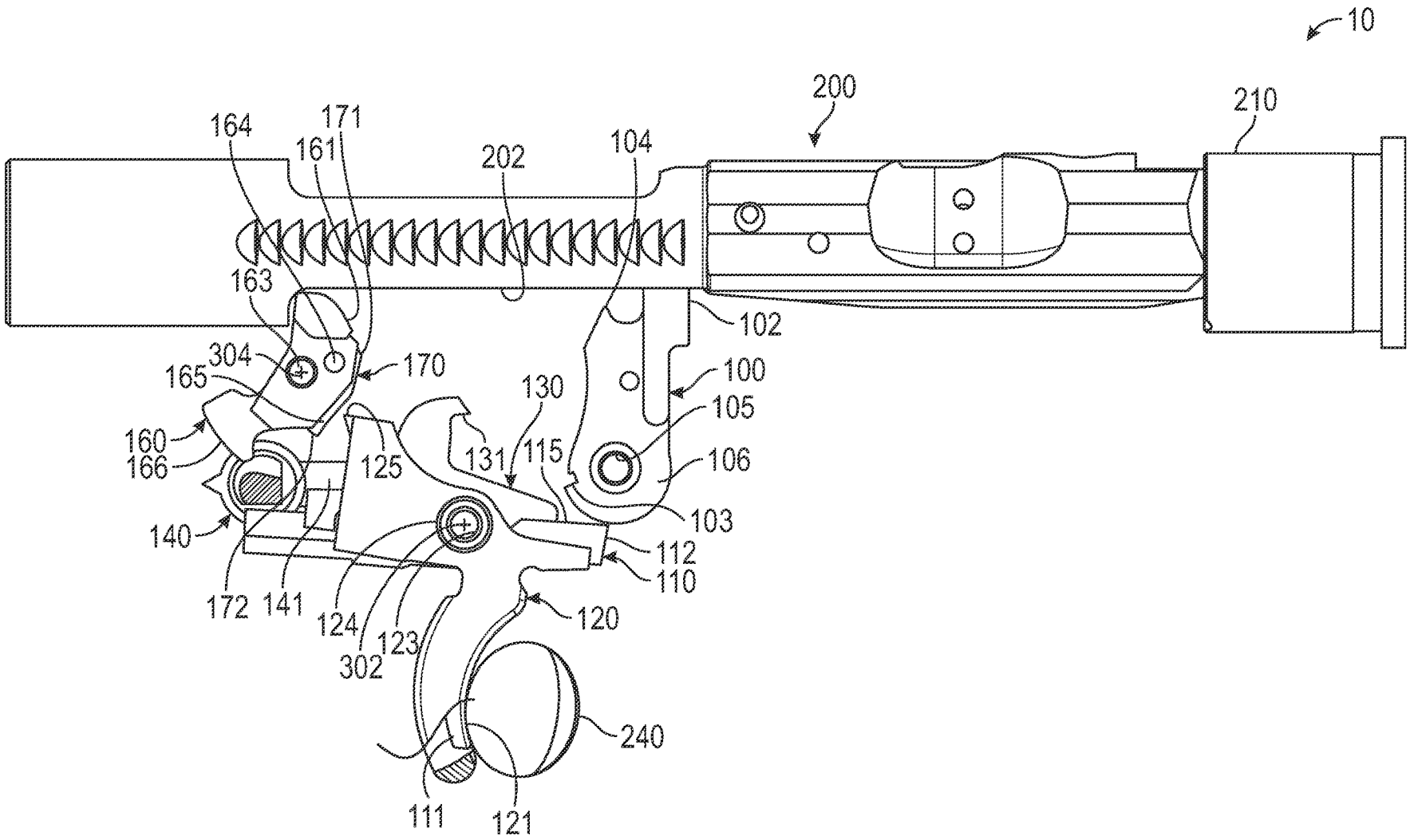
FIG. 6 is a side view of the trigger assembly for a firearm of FIG. 1 with a portion of the shroud element shown cutaway with the reciprocating action element of the complete host firearm beginning to cycle, the link moved between the engaged and the disengaged position, and the link disconnector in the disengaged position.

FIG. 6 illustrates the improved trigger assembly for a firearm 10 of the present invention. More particularly, the hammer 100 is shown in the striking position. The hammer has been released from the cocked position by the sear surface 112 of the trigger element 110 and allowed to rotate unimpeded under spring bias. In this position, the firing mechanism of the host firearm 300 has been activated to discharge a shot.

Figure 7:
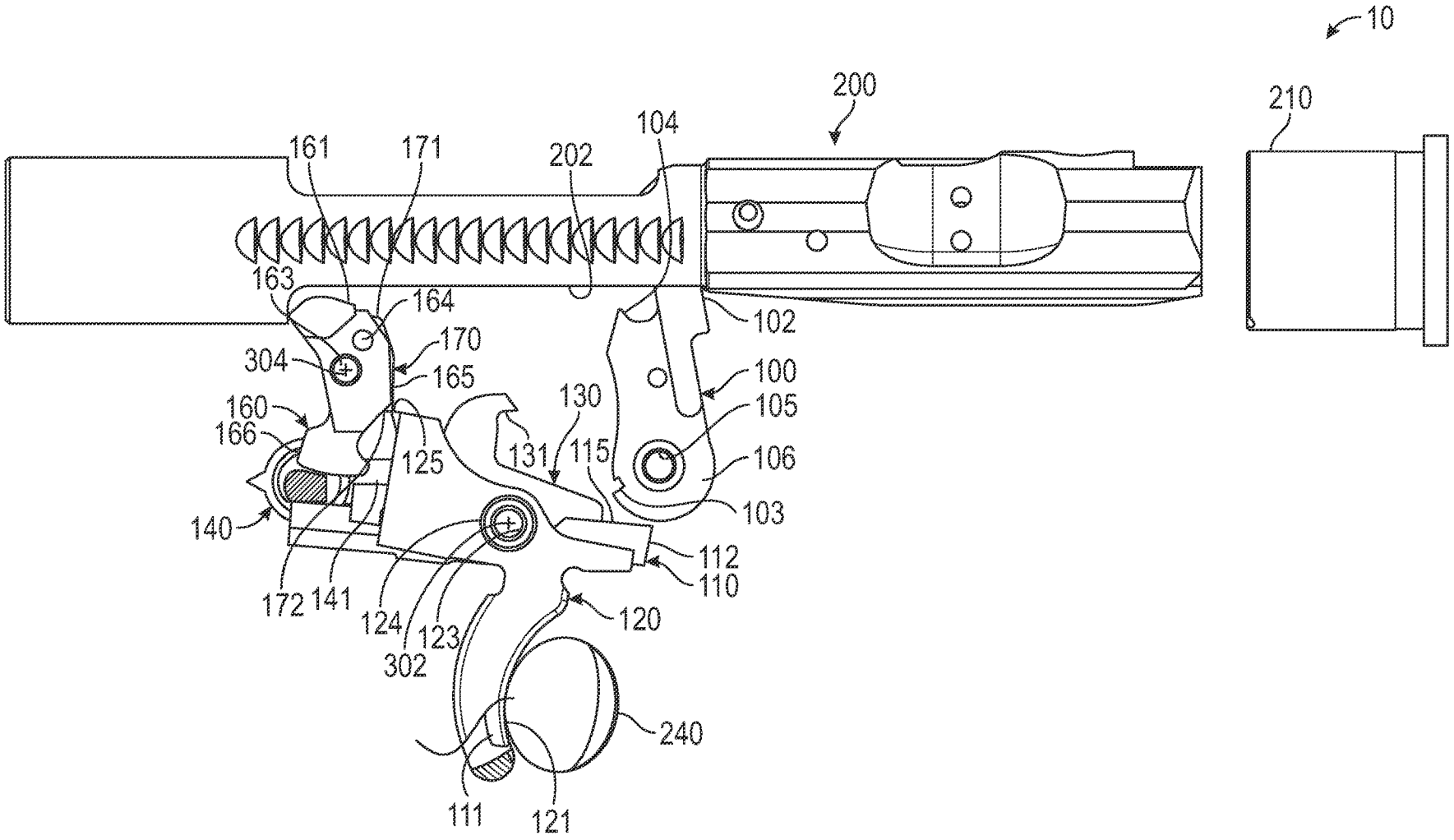
FIG. 7 is a side view of the trigger assembly for a firearm of FIG. 1 with a portion of the shroud element shown cutaway with the reciprocating action element of the firearm having cycled further rearward relative to FIG. 6, the link in the disengaged position, and the link disconnector in the engaged position.
Figure 8:
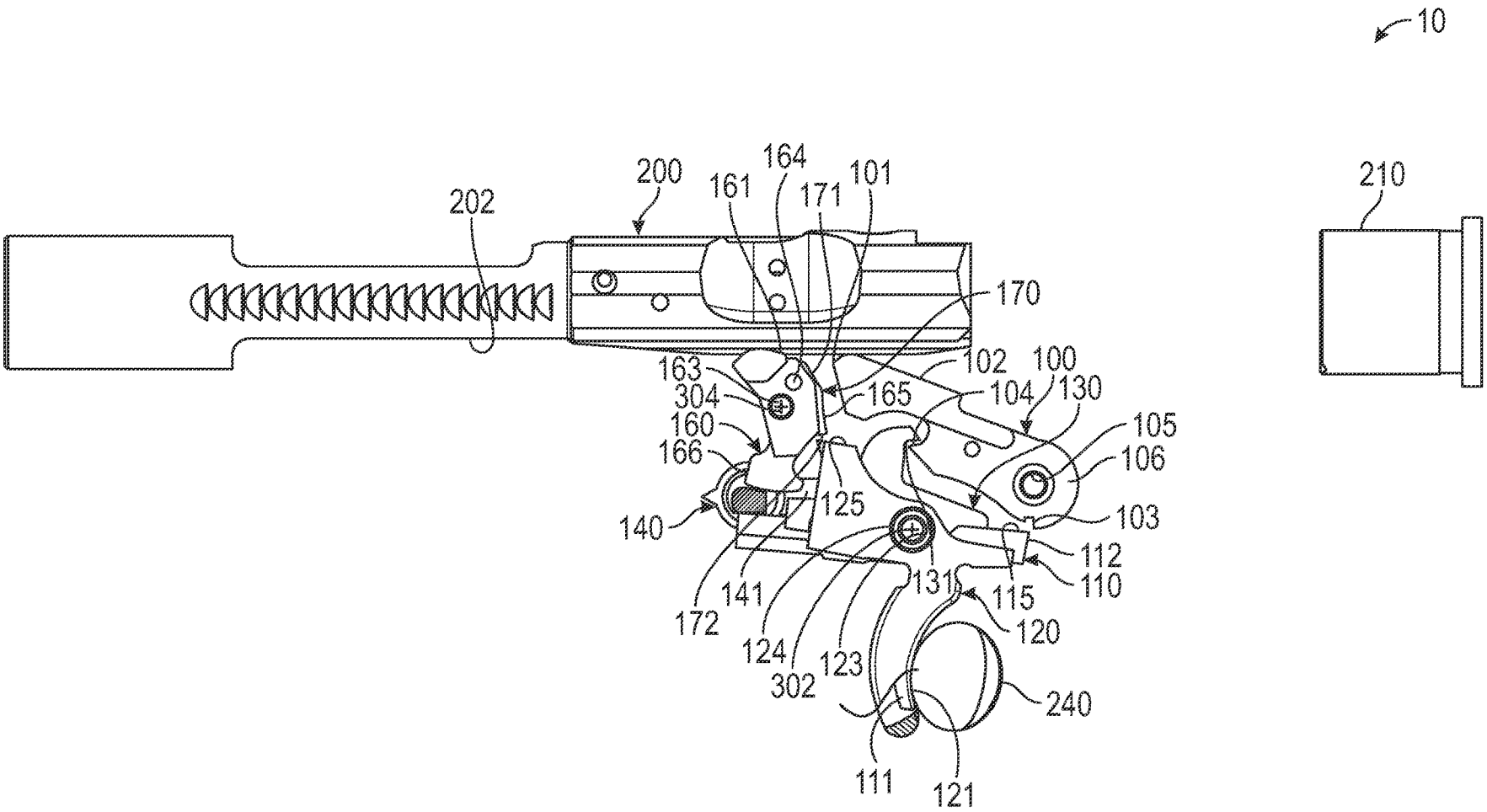
FIG. 8 is a side view of the trigger assembly for a firearm of FIG. 1 with a portion of the shroud element shown cutaway with the action nearing the end of the cycle and the hammer in the disconnected position caught on the hook of the disconnector.

FIGS. 7 & 8 illustrate the improved trigger assembly for a firearm 10 of the present invention. More particularly, the first half of the cycling of the action of the host firearm 300 is depicted. The reciprocating action element 200 has moved from the in-battery position to the rearward recoil position, against spring bias (spring not shown), in response to the discharge of a shot. The reciprocating action element has moved from a position of engaging the link 160 via the second contact surface 202 and the top contact surface 161 to a condition of disengagement. The link is thus allowed to rotate from the engaged position to the disengaged position under spring bias (spring not shown). During the transition of the link from the engaged position to the disengaged position, the link disconnector 170 moves with the link and the lower contact surface 172 traverses the path of the contact surface 125 of the shroud element 120. This interaction moves the link disconnector from the engaged position to the disengaged position and back to the engaged position to allow the lower contact surface 172 of the link disconnector to reposition above the contact surface 125 of the shroud element. The first contact surface 201 of the reciprocating action element simultaneously acts upon the top surface 101 of the hammer 100, meaning the hammer interfaces a forward portion of the reciprocating action element) to rotate the hammer against spring bias (spring not shown) into a position in which the rear hook 104 of the hammer is aligned with the hook 131 of the disconnector 130 to retain the hammer in the disconnected position once the reciprocating action element has disengaged the hammer.

Figure 9:
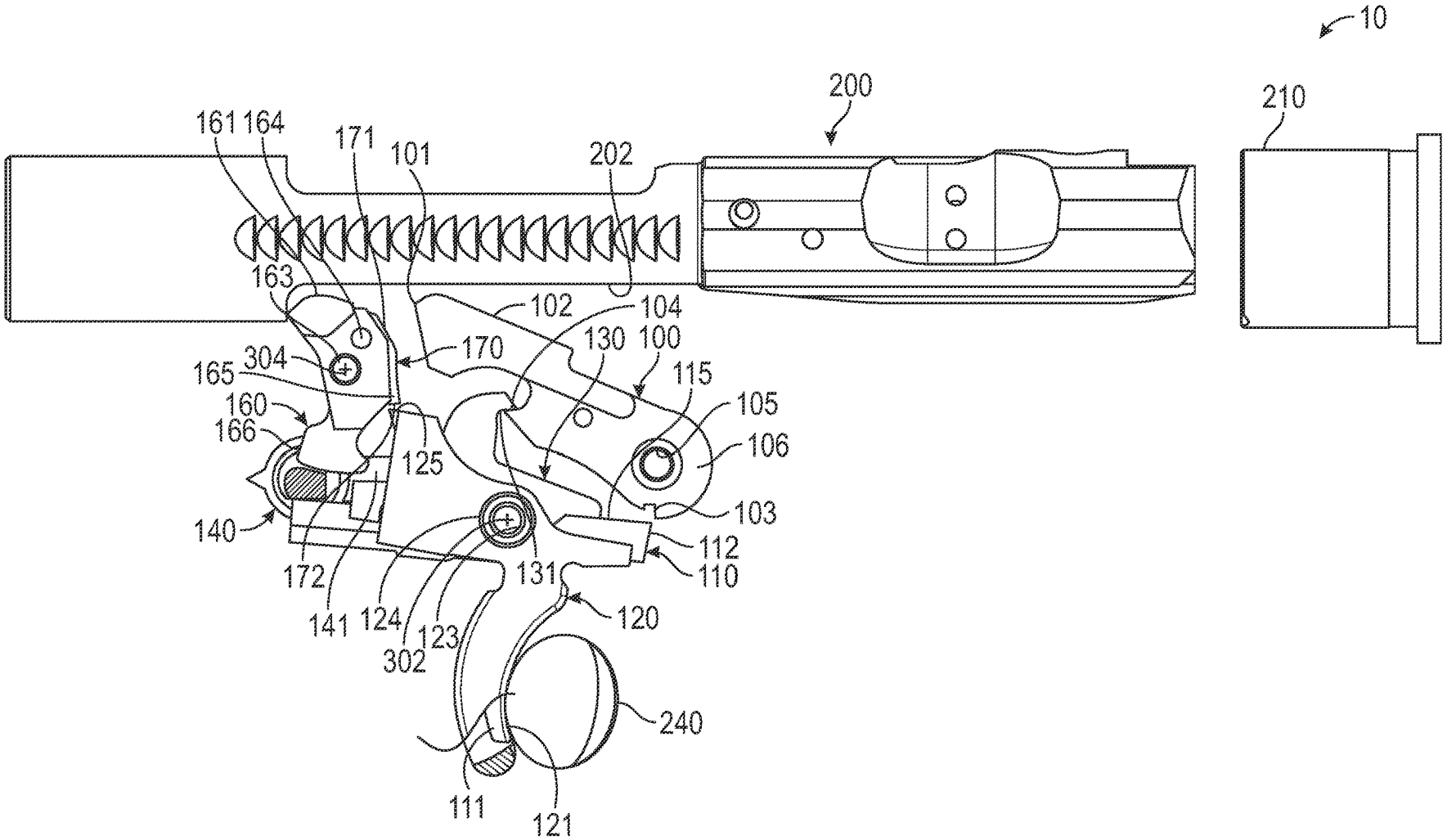
FIG. 9 is a side view of the trigger assembly for a firearm of FIG. 1 with a portion of the shroud element shown cutaway with the reciprocating action element nearer to the end of the cycle relative to FIG. 8. The link is acted upon by the reciprocating action element, the link disconnector acts to transfer the motion of the reciprocating action element to the shroud element, the shroud element forces the user's finger forward, and the trigger element is allowed to move from the rearward actuated position to the forward released position.
Figure 10:
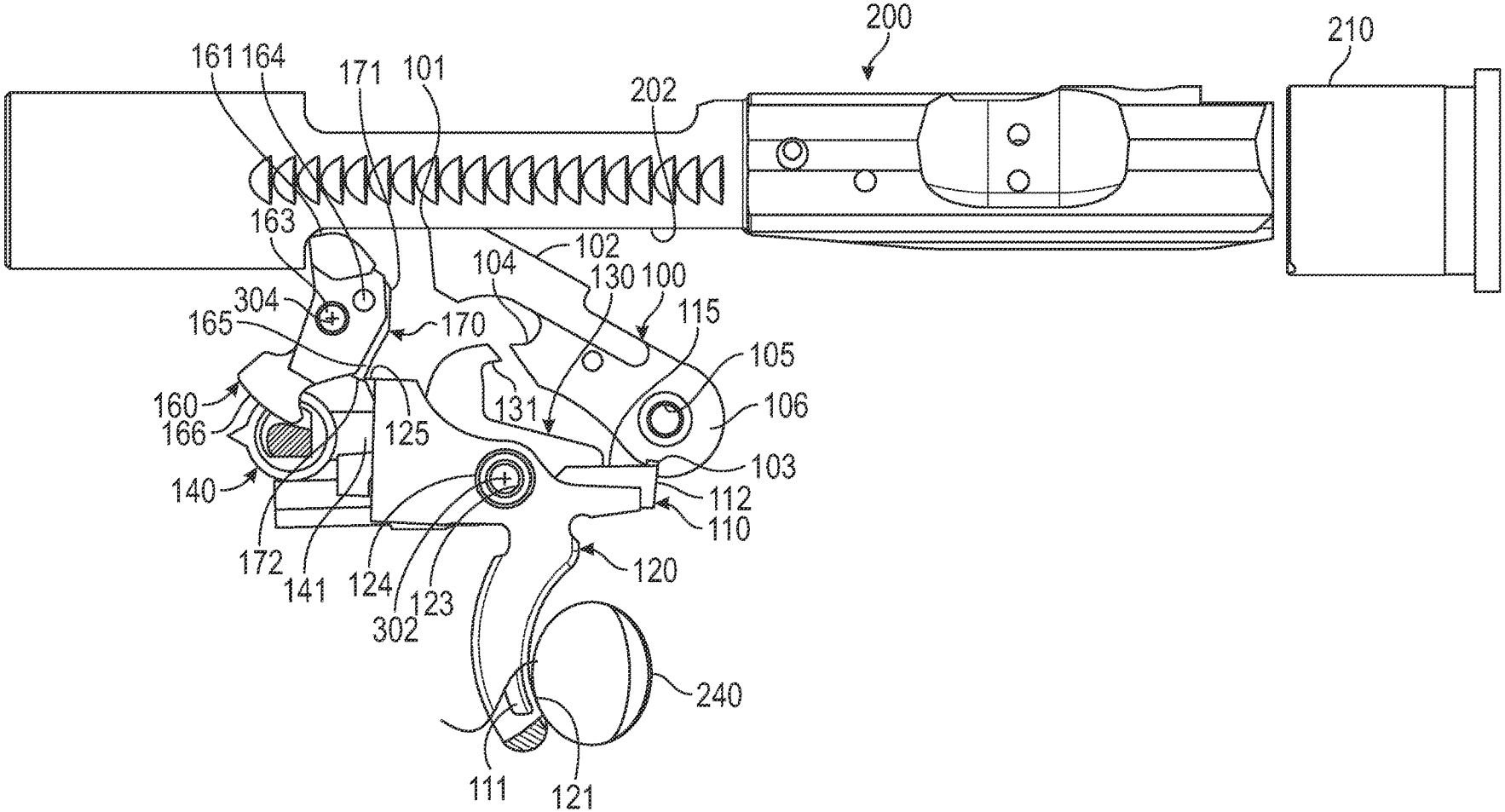
FIG. 10 is a side view of the trigger assembly for a firearm of FIG. 1 with a portion of the shroud element shown cutaway with the reciprocating action element having completed the cycle. The link is in the engaged position, and the link disconnector is in the engaged position but moved far enough to be out of contact with the shroud element. The shroud element is positioned far enough forward that the user's finger is completely out of contact with the trigger element, but no component prevents the shroud element from moving rearward in response to the pull of the user's finger.

FIGS. 9 & 10 illustrate the improved trigger assembly for a firearm 10 of the present invention. More particularly, a portion of the second half of the cycling of the action of the host firearm 300 is depicted. The reciprocating action element 200 returns under spring bias (spring not shown) from the rearward recoil position toward the in-battery position. The top surface 161 of the link 160 begins to be reengaged by the second contact surface 202 of the reciprocating action element, meaning the link interfaces the reciprocating action element at a bolt assembly surface rearward of the forward portion of the reciprocating action element. As the link is rotated about axis 304, the link disconnector 170, which shares a contact point between the inner contact surface 162 and the top contact surface 171 of the link, is rotated as well. The lower contact surface 172 of the link disconnector begins to engage the top contact surface 125 of the shroud element 120, forcing the shroud element 120 to rotate toward the rest state, further forcing the user's finger 240 forward in opposition to the user's pull effort via the finger pad 121 of the shroud element. This means the link is operable in response to a forward force by the reciprocating action element on the first link portion to transmit a biasing force on the shroud element to bias the finger pad of the shroud element toward the forward disabling position. As the user's finger is forced forward, the trigger element 110 and the disconnector 130 are allowed to rotate under spring bias (springs not shown) toward their rest state (the forward released position in the case of the trigger element). The movement of the trigger element and the disconnector transition the hammer 100 from being held in the disconnected position by the engagement of the hook 131 of the disconnector and the lower hook 103 of the hammer, to the cocked position where the hammer is held by the engagement of the sear surface 112 with the lower hook of the hammer. At this point, the trigger assembly for a firearm 10 has fully reset having gone through one full cycle of semi-automatic fire.

The primary function of the shroud element 120 is to force the user's finger 240 away from any contact with the trigger element 110 after the reset condition of the trigger assembly for a firearm 10 has been reached. Thus, the finger pad 121 of the shroud element 120 is forward of the finger pad 111 of the trigger element 110 when the finger pad of the shroud element is in the disabling position. The lower contact surface 172 of the link disconnector 170 eventually rotates enough to clear the top contact surface of 125 of the shroud element 120. This clearance means any pull effort exerted by the user's finger is no longer opposed by the transfer of motion from the action via the link 160, link disconnector 170, and the shroud element 120. The user's finger is therefore free to return in the direction of pull, and the entire firing cycle described herein is repeated.

The selector 140 has three positions. The user can manipulate the mode of fire of the trigger assembly for a firearm 10 by adjusting the orientation of the selector via the paddle 141. The first mode acts to limit the travel of the trigger element 110 to prevent the release of the hammer 100 from the cocked position to the striking position. This blocking action is achieved by the interaction of the first contact profile 142 on the selector and the rear contact surface 117 of the trigger element.

The second mode of fire is traditional semi-automatic fire in which the selector 140 interacts with the link 160 via a blocking operation between the fin 166 on the link and the second contact profile 143 on the selector to prevent the link from moving out of the engaged position. When trapped in the engaged position, the link never moves far enough to allow an interaction between the link disconnector 170 and the shroud element 120, which prevents any forcing of the shroud element position by the link during the firing cycle.

The third mode of fire is forced separation mode in which the selector 140 no longer engages the link 160 so the link may freely operate as described previously to force the user's finger 240 forward after a shot is discharged. Thus, the selector interfaces the link and is movable between a first operating condition in which link movement is enabled to motivate the shroud element 120 and a second operating condition in which link movement is disabled from motivating the shroud element. The selector also interfaces the trigger element 110 and is movable to a third position in which operation of the trigger element is disabled. The selector is moveable between a plurality of positions and is biased to discrete positions, each defining a different mode of operation of the trigger assembly for a firearm 10.

Figure 11:
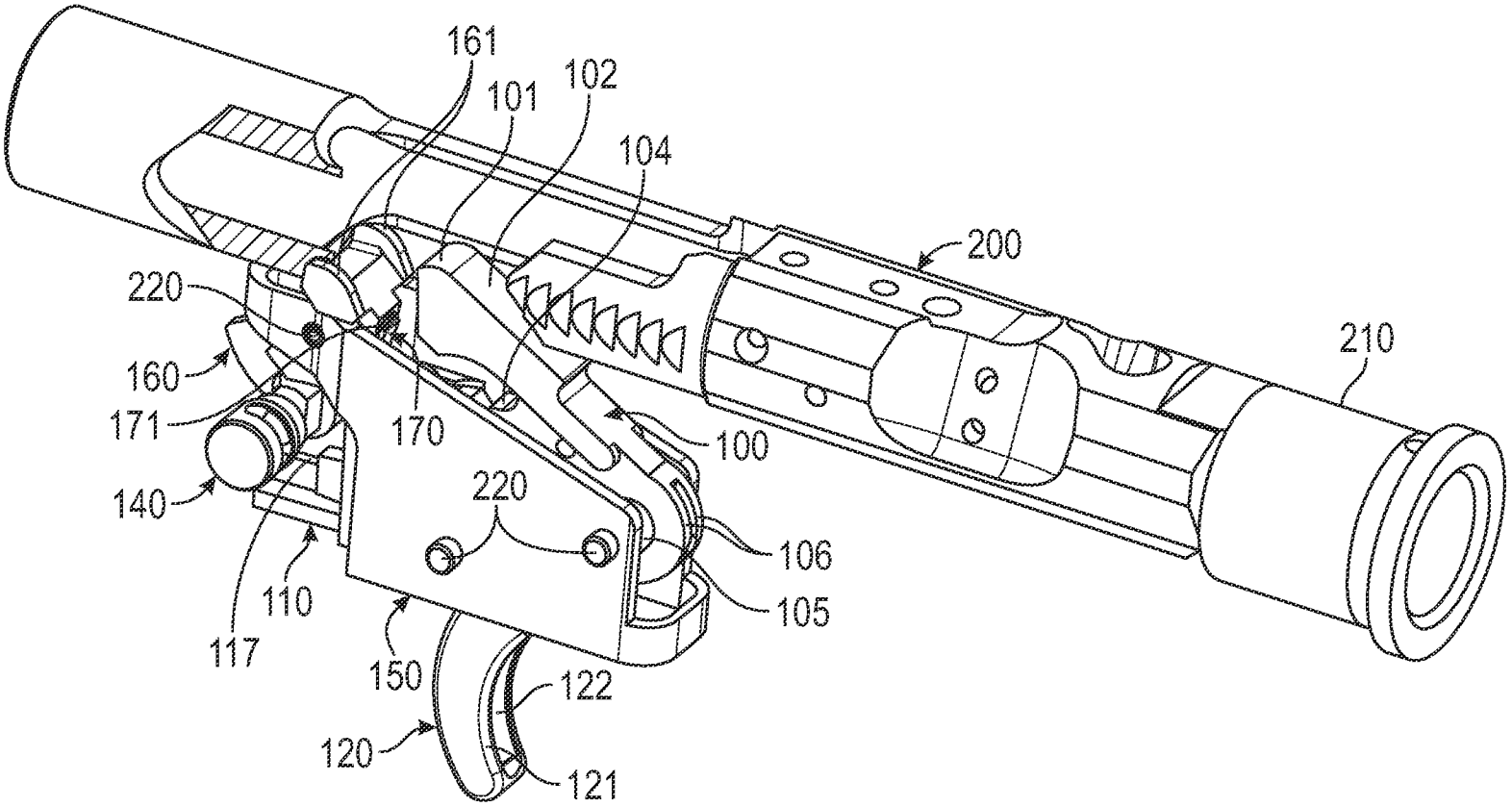
FIG. 11 is a top isometric view of the trigger assembly for a firearm of FIG. 1 with the reciprocating action element partially cutaway.

FIG. 11 illustrates the improved trigger assembly for a firearm 10 of the present invention. More particularly, the reciprocating action element 200 is partially cutaway to show the reciprocating action element engaging with the link 160 when the reciprocating action element is in battery.

Figure 12:
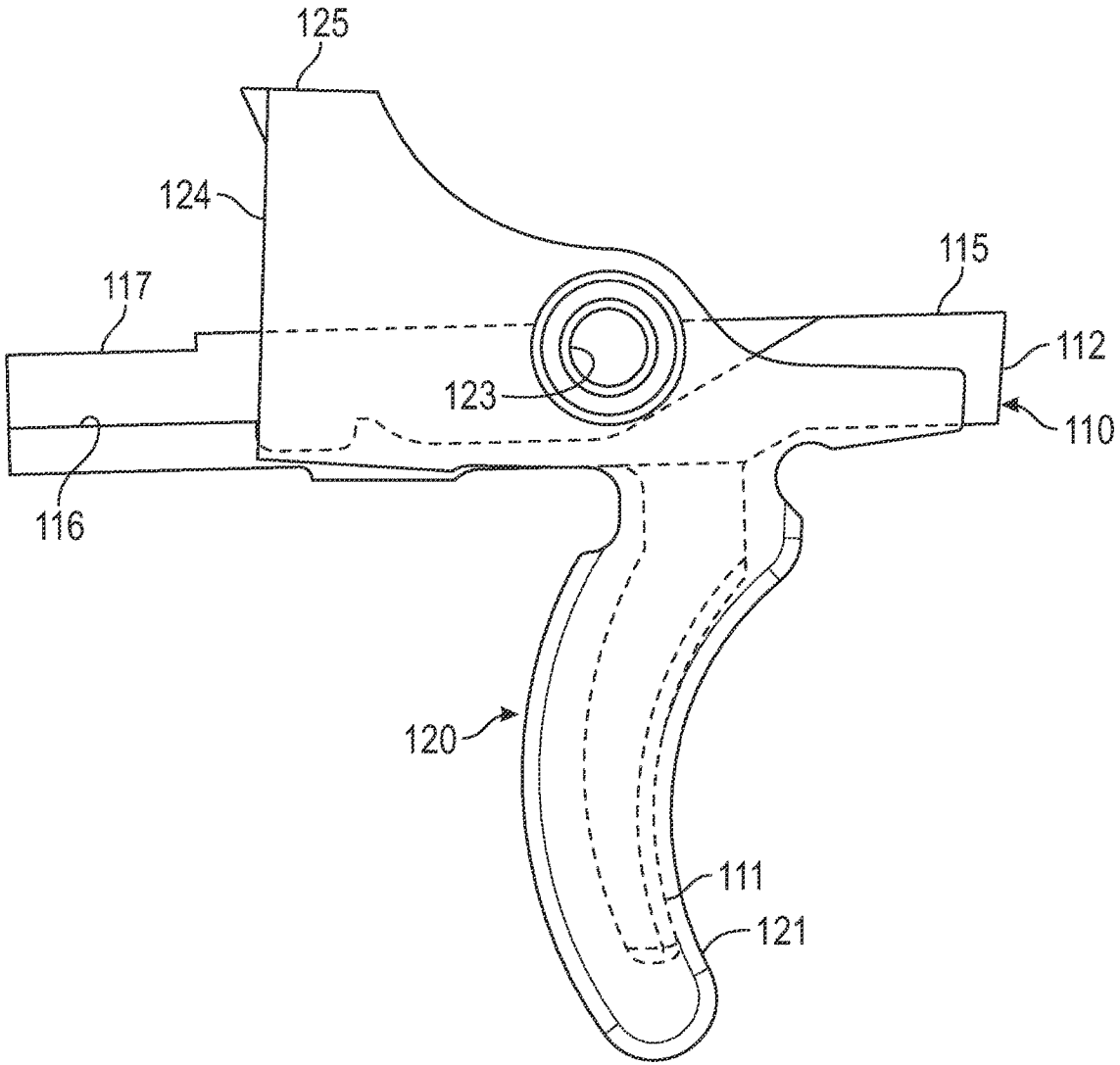
FIG. 12 is an enlarged right side view of the shroud element and trigger element of FIG. 1.
Figure 13:
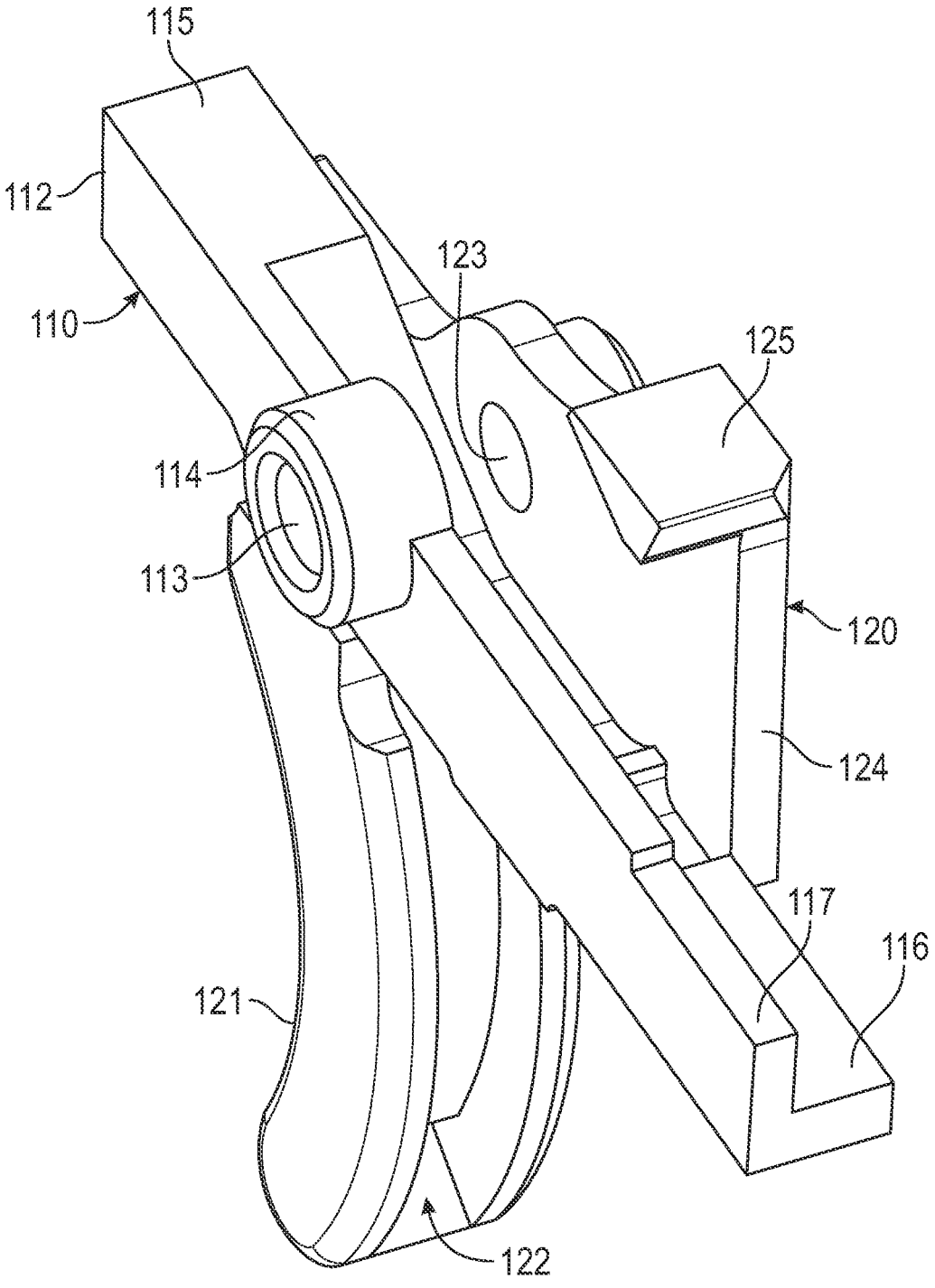
FIG. 13 is an enlarged rear isometric view of the shroud element and trigger element of FIG. 1.
Figure 14:
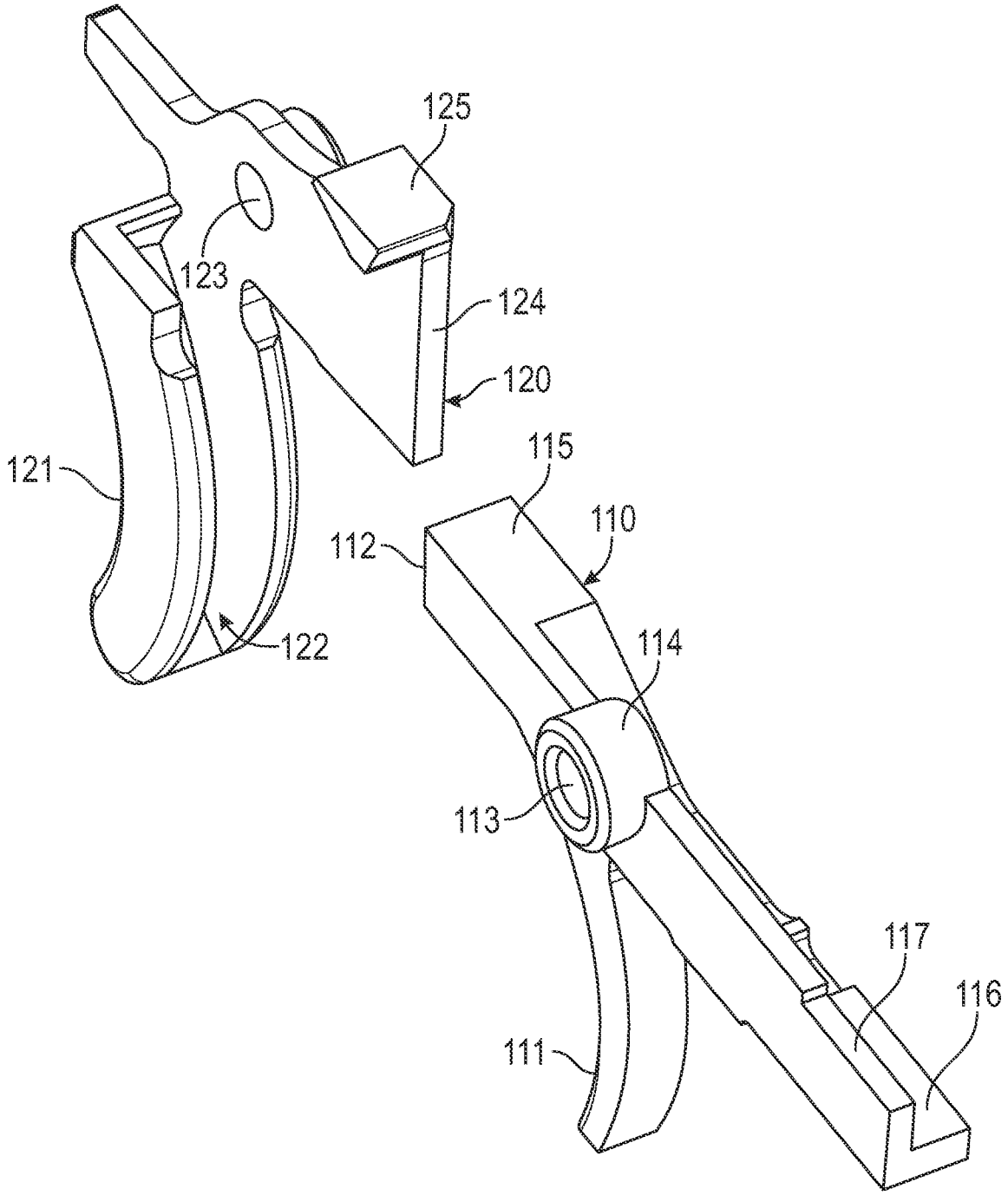
FIG. 14 is an enlarged exploded view of the shroud element and trigger element of FIG. 1.

FIGS. 12-14 illustrate the improved trigger element 110 and shroud element 120 of the present invention. More particularly, the dashed lines in FIG. 12 indicate how the shroud element covers portions of the trigger element when the trigger element and the shroud element are in the disengaged position. Their relative positions ensure that when the user's finger begins to pull, the user's finger will act solely on the shroud element initially. It should be appreciated that the shroud element and trigger element do not constrain each other's motion in any way other than the shroud element preventing the user's finger from initially moving the trigger element when beginning to pull. The shroud element and trigger element have no hard-contact limits with each other.

It should also be appreciated that the hammer is moveable between a disconnected position, a cocked position, and a striking position with the hammer being biased toward the striking position. The trigger element is moveable between a forward released position and a rearward actuated position with the trigger element being biased toward the forward released position. The shroud element is moveable between a forward disabling position and a rearward enabling position with the shroud element being biased toward the forward disabling position. The shroud element encapsulates the trigger element on at least two sides within slot 122 so as to prevent a user from touching the trigger element when the shroud element is in the forward disabling position. The disconnector is moveable between an engaged and a disengaged position with the disconnector being biased toward the disengaged position. The disconnector is operably connected to the trigger element and moveable in response to the position of the trigger element. The link is moveable between an engaged position and a disengaged position with the link being biased toward the engaged position. The link is variably engaged to the shroud element to momentarily force the shroud element to the rest position after the discharge of the host firearm and the subsequent reset of the hammer to its cocked position.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a trigger assembly for a firearm has been described in detail, it should be apparent that modifications and variations thereto are possible, all of which fall within the true spirit and scope of the invention. Although a reciprocating bolt assembly for a rifle has been disclosed, the invention is also suitable for use with a pistol having a reciprocating slide. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trigger assembly for a firearm having a reciprocating action element movable between a rear recoil position and a forward battery position, the trigger assembly comprising:

a frame;

a trigger element pivotally connected to the frame and having a trigger lever operable for movement between a forward released position and a rearward actuated position;

a hammer pivotally connected to the frame and movable between a cocked position and a striking position;

a shroud element shrouding the trigger lever and pivotally connected to the frame having a shroud lever operable for movement between a forward disabling position in which a user's finger cannot move the trigger lever when pulling the shroud lever and a rearward enabling position in which the user's finger also moves the trigger lever when pulling the shroud lever;

a link pivotally connected to the frame and having a first portion operably interfacing the reciprocating action element and a second portion operably interfacing the shroud element; and the link being operable when the reciprocating action element moves from the rear recoil position to the forward battery position to motivate the shroud element from the rearward enabling position to the forward disabling position.

2. The trigger assembly of claim 1 wherein the shroud element and trigger element pivot about a common axis.

3. The trigger assembly of claim 1 including a selector interfacing the link and movable between a first operating condition in which link movement is enabled to motivate the shroud element and a second operating condition in which link movement is disabled from motivating the shroud element.

4. The trigger assembly of claim 3 wherein the selector interfaces the trigger element and is movable to a third position in which operation of the trigger element is disabled.

5. The trigger assembly of claim 1 wherein the link is movable between an inactive position enabling the shroud lever to be in the rearward enabling position, and a link active position contacting the shroud lever.

6. The trigger assembly of claim 5 wherein the link is operable in response to a forward force by the reciprocating action element on the first link portion to transmit a biasing force on the shroud element to bias the shroud lever toward the forward disabling position.

7. The trigger assembly of claim 1 wherein the shroud lever is forward of the trigger lever when the shroud lever is in the disabling position.

8. The trigger assembly of claim 1 wherein the hammer interfaces a forward portion of the reciprocating action element, and the link interfaces the reciprocating action element at a bolt assembly surface rearward of the forward portion of the reciprocating action element.

9. The trigger assembly of claim 1 wherein the reciprocating action element is a reciprocating bolt assembly.

* * * * *